US007246397B2

(12) United States Patent
Kim et al.

(10) Patent No.: US 7,246,397 B2
(45) Date of Patent: Jul. 24, 2007

(54) METHOD FOR CONTROLLING DEHYDRATING OPERATION OF DRUM TYPE WASHING MACHINE

(75) Inventors: Jin Woong Kim, Kwangmyong-shi (KR); Hyun Seok Seo, Inchonkwangyok-shi (KR); Tae Hee Lee, Seoul (KR); Joon Woo Kim, Kwangmyong-shi (KR); Kyung Chul Woo, Seoul (KR); Si Moon Jeon, Seoul (KR); Soo Young Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 610 days.

(21) Appl. No.: 10/422,860

(22) Filed: Apr. 25, 2003

(65) Prior Publication Data

US 2004/0068804 A1 Apr. 15, 2004

(30) Foreign Application Priority Data

Oct. 10, 2002 (KR) ..... 10-2002-0061838
Oct. 10, 2002 (KR) ..... 10-2002-0061839

(51) Int. Cl.
*D06F 33/02* (2006.01)

(52) U.S. Cl. ..... 8/159; 68/12.06

(58) Field of Classification Search ..... 8/159; 68/12.06, 23.1

See application file for complete search history.

(56) References Cited

U.S. PATENT DOCUMENTS 2,950,613 A * 8/1960 Bochan ..... 68/12.14
3,186,104 A * 6/1965 Stilwell, Jr. ..... 34/527
3,640,098 A * 2/1972 Eastall ..... 68/12.06
4,607,408 A * 8/1986 Didier et al. ..... 8/159
4,782,544 A * 11/1988 Nystuen et al. ..... 8/159
4,856,301 A * 8/1989 Broadbent ..... 68/12.23
5,076,076 A * 12/1991 Payne ..... 68/12.14
5,181,398 A 1/1993 Tanaka et al.
5,543,698 A * 8/1996 Tao et al. ..... 318/611
5,671,494 A * 9/1997 Civanelli et al. ..... 8/159
5,887,456 A 3/1999 Tanigawa et al.
5,906,056 A * 5/1999 Noguchi et al. ..... 34/596
6,032,494 A * 3/2000 Tanigawa et al. ..... 68/12.06
6,282,965 B1 * 9/2001 French et al. ..... 73/660
6,393,918 B2 * 5/2002 French et al. ..... 73/660
6,532,422 B1 * 3/2003 Elgersma et al. ..... 702/41
6,578,225 B2 6/2003 Jönsson
6,715,175 B2 * 4/2004 Ciancimino et al. ..... 8/159
2001/0054204 A1 12/2001 Ciancimino et al.

FOREIGN PATENT DOCUMENTS

DE 38 12 090 * 10/1989
DE 42 35 614 A1 4/1994

(Continued)

*Primary Examiner*—Frankie L. Stinson
(74) *Attorney, Agent, or Firm*—Birch, Stewart, Kolasch & Birch, LLP

(57) ABSTRACT

A method for controlling the dehydrating operation of a drum type washing machine includes a pre-acceleration step for accelerating a drum to a predetermined control starting speed, and a main accelerating step for accelerating the drum from the control starting speed to a target speed along a linear locus having a preset acceleration slope. A deviation of the center of gravity of the laundry and a pre-spinning time period are reduced in the aforementioned control method.

20 Claims, 7 Drawing Sheets

FOREIGN PATENT DOCUMENTS

| | | | | |
|---|---|---|---|---|
| DE | 44 31 846 | A1 | | 3/1996 |
| DE | 196 29 359 | A1 | | 1/1998 |
| JP | 8-238393 | | * | 9/1996 |
| JP | 2000-014961 | A | | 1/2000 |
| JP | 2001-276468 | | | 9/2001 |
| KR | 2001-0017348 | A | | 3/2001 |

* cited by examiner

FIG. 6

| Slope of acceleration [rpm/sec] | Pre-spinning time period(sec) | Number of main spinning starting attempts |
|---|---|---|
| Background Art | 561 | 30 |
| 5.5 | 65 | 2.8 |
| 3.7 | 81 | 3.6 |
| 2.8 | 118 | 4.0 |

METHOD FOR CONTROLLING DEHYDRATING OPERATION OF DRUM TYPE WASHING MACHINE

CROSS-REFERENCES TO RELATED APPLICATIONS

This non-provisional application claims priority under 35 U.S.C. § 119(a) on Patent Application Nos. P2002-61838 and P2002-61839 both filed in Korea on Oct. 10, 2002, the entirety of each of which are herein incorporated by reference.

BACKGROUND OF THE INVENTION

1. Field of the Invention

The present invention relates to a method for controlling a dehydrating operation of a drum type washing machine, and more particularly to a method in which a speed of a motor for driving a drum is controlled to be at an optimum during spinning for reducing both a deviation of the center of gravity of a load of laundry, and a pre-spinning time period.

2. Description of the Background Art

In general, a washing machine carries out washing, rinsing and spinning operations for the removal of dirt adhering to clothes by actions of detergent and water. The washing machines of the background art include water circulation type (pulsator type), agitating type (washing rod type), and drum type washing machines.

In a drum type washing machine, the detergent, washing water and laundry are introduced into a drum having a plurality of lifters. The washing process in the drum type washing machine includes impact caused by the lifters lifting and dropping laundry, friction between the laundry and the washing water, and the chemical reaction of the detergent as the drum slowly rotates about a horizontal shaft.

Drum type washing machines are being used more frequently in the background art due to several advantageous features. For example, the laundry suffers little or no damage, laundry is prevented from entanglement, the washing effects of pounding and rubbing can be provided, and a relatively small amount of water is used in drum type washing machines.

Referring to FIG. 1, the motor of the drum type washing machine accelerates to a target revolution speed during a spinning operation of the drum type washing machine. The motor is then driven at a constant speed for a preset time period once it reaches the target revolution speed. A gravity deviation of the laundry is sensed from a variation of the revolution speed caused by the deviation of the center of gravity in the drum to determine a starting point of a main spinning cycle. In this instance, if the deviation is within a preset range, the main spinning progresses. If the deviation is not within the preset range, the motor is stopped and the motor is re-started to bring the deviation below the preset level before starting the main spinning.

However, when controlling the motor in the aforementioned manner, the motor speed rises sharply because no particular speed control is provided during the acceleration of the motor to the target revolution. The acceleration is irregular during this period due to both the deviation of the center of gravity of the laundry in the drum and the falling of the laundry in the drum. The deviation particularly increases as the laundry gathers to one side of an inside wall of the drum. Accordingly, the pre-spinning cycle requires repeated and frequent stopping and re-starting of the motor that results in a prolonged pre-spinning time period.

A spinning control method of the background art has a long pre-spinning time period, e.g., from the start of the spinning cycle to the start of the main spinning, because of the constant speed operation of the motor for the preset time period before the main spinning for sensing deviation of the center of gravity for the determination of the start of the main spinning cycle.

SUMMARY OF THE INVENTION

The present invention overcomes the shortcomings associated with the background art and achieves other advantages not realized by the background art. The present invention is directed to a method of controlling a dehydrating operation of a drum type washing machine that substantially obviates one or more of the aforementioned problems of the background art.

An object of the present invention is to provide a method for controlling a dehydrating operation of a drum type washing machine, in which a motor speed of a drum is controlled to an optimum speed during spinning.

An object of the present invention is to provide a method for controlling a dehydrating operation of the drum type washing machine that prevents the occurrence of sharp speed increases of the motor during acceleration of the motor.

Another object of the present invention is to provide a method for controlling the dehydrating operation of a drum type washing machine that reduces the deviation of the center of gravity of a load of laundry during spinning and pre-spinning operating periods.

One or more of these and other objects are accomplished by a method for controlling a dehydrating operation of a drum type washing machine, said method comprising accelerating a motor driving a drum of the washing machine to a predetermined control starting speed during a pre-acceleration step; and accelerating the motor from the control starting speed to a target speed along a linear locus having a preset acceleration slope during a main acceleration step.

The method for controlling dehydrating operation of a drum type washing machine includes a pre-acceleration step for accelerating a motor for driving a drum to a predetermined control starting speed, and a main accelerating step for accelerating the motor from the control starting speed to a target speed along a linear locus having a preset acceleration slope. The motor is controlled by PID (Proportional Integral Derivative) control in the main accelerating step. The control starting speed is 40±5 rpm, and the target speed is 110±20 rpm.

The method further includes the step of running at constant speed for a time period for determining the starting of a main spinning step when the motor speed reaches the target speed. The determination of the starting of the main spinning step from the constant speed running step is made by measuring the deviation of the drum with reference to a variation of speed. The main spinning step is started if the deviation measured in the constant speed running step is within a preset value. The motor is stopped temporarily and re-started if the deviation measured in the constant speed running step is greater than the preset value.

The method further includes the step of predicting the deviation during the main acceleration. The step of predicting the deviation includes the steps of monitoring a difference between the speed on the linear locus and the actual sensed speed for a number of times for a preset time period during progression of the main acceleration step, and calculating an average of the monitored differences between the speeds on the locus and the actual sensed speeds to measure the deviation.

The method further includes the step of determining the starting of the constant speed running step for sensing an actual accurate deviation with reference to the deviation predicted in the deviation predicting step. The step of determining the starting of the constant speed running step includes the step of stopping and re-accelerating the motor if the predicted deviation is greater than the preset value, or the step of running at constant speed for sensing an accurate deviation by running the motor at a fixed speed for a preset time period after the motor reaches the target speed if the predicted deviation is smaller than the preset value.

The method further includes the step of determining the starting of the main spinning cycle with reference to the deviation measured in the deviation predicting step. The step of determining the starting of the main spinning cycle includes the step of stopping and re-accelerating the motor if the predicted deviation is greater than the preset value, or the step of starting the main spinning step directly after the target speed is reached if the predicted deviation is smaller than the preset value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 6 is a table comparing the operation control method of the first embodiment shown in FIG. 5 and the operation control method of the background art showing pre-spinning time periods and a number of main spinning attempts thereof;

DETAILED DESCRIPTION OF THE PREFERRED EMBODIMENTS

Figure 2:
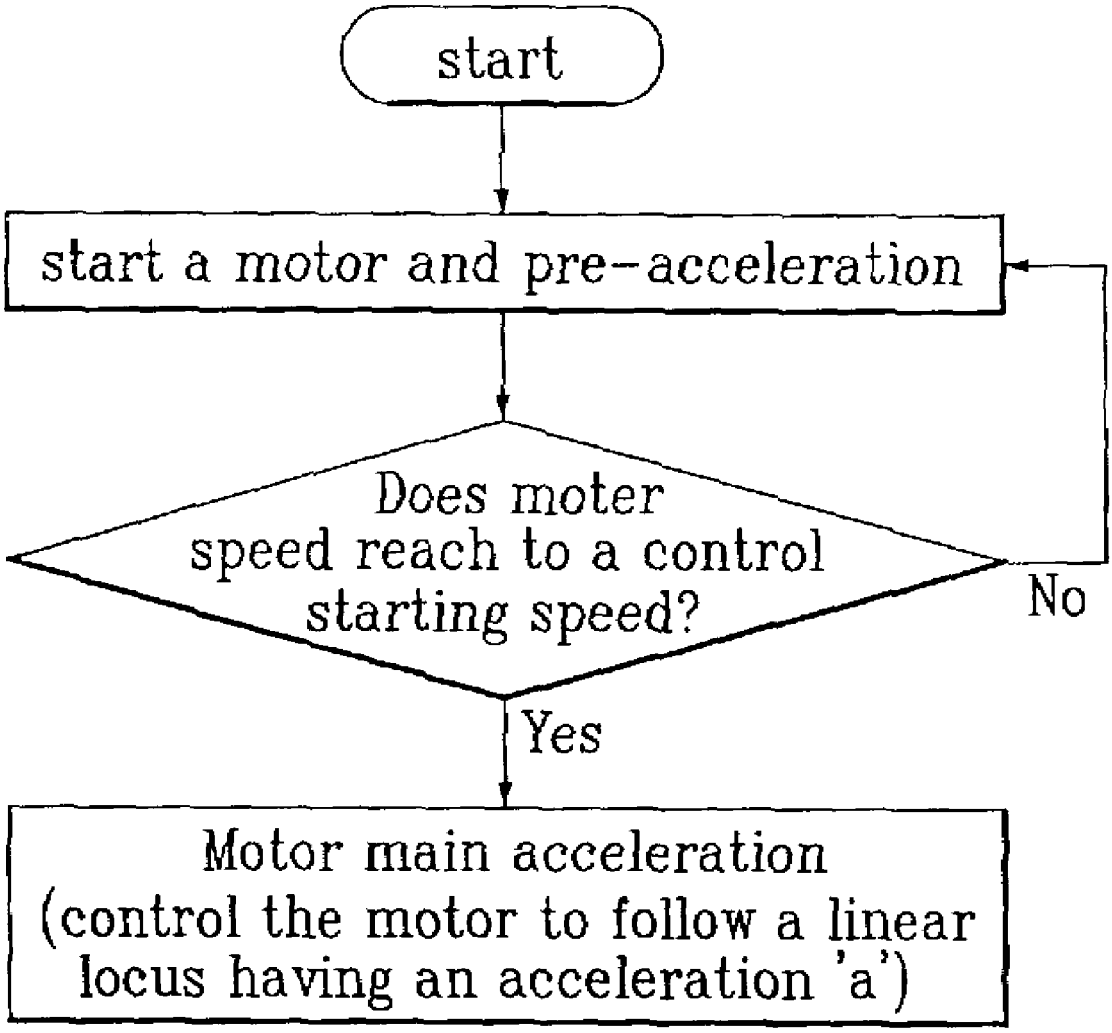
FIG. 2 is a flow chart of method steps for controlling the dehydrating operation of a drum type washing machine in accordance with a preferred embodiment of the present invention.
Figure 3:
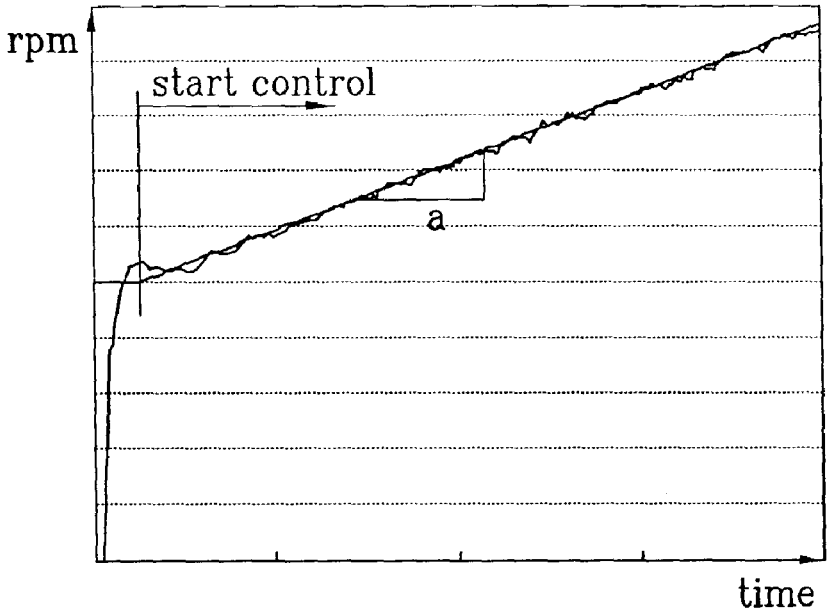
FIG. 3 is a graphical view of a state of motor speed control under a no load condition in accordance with a preferred embodiment of the present invention.
Figure 4:
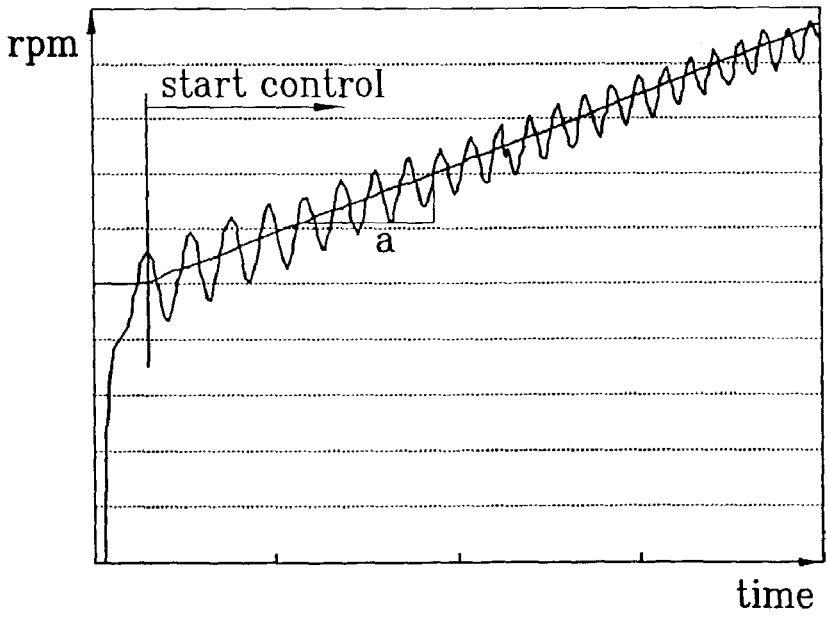
FIG. 4 is a graphical view of a state of motor speed control under a preset load condition in accordance with a preferred embodiment of the present invention.
Figure 5:
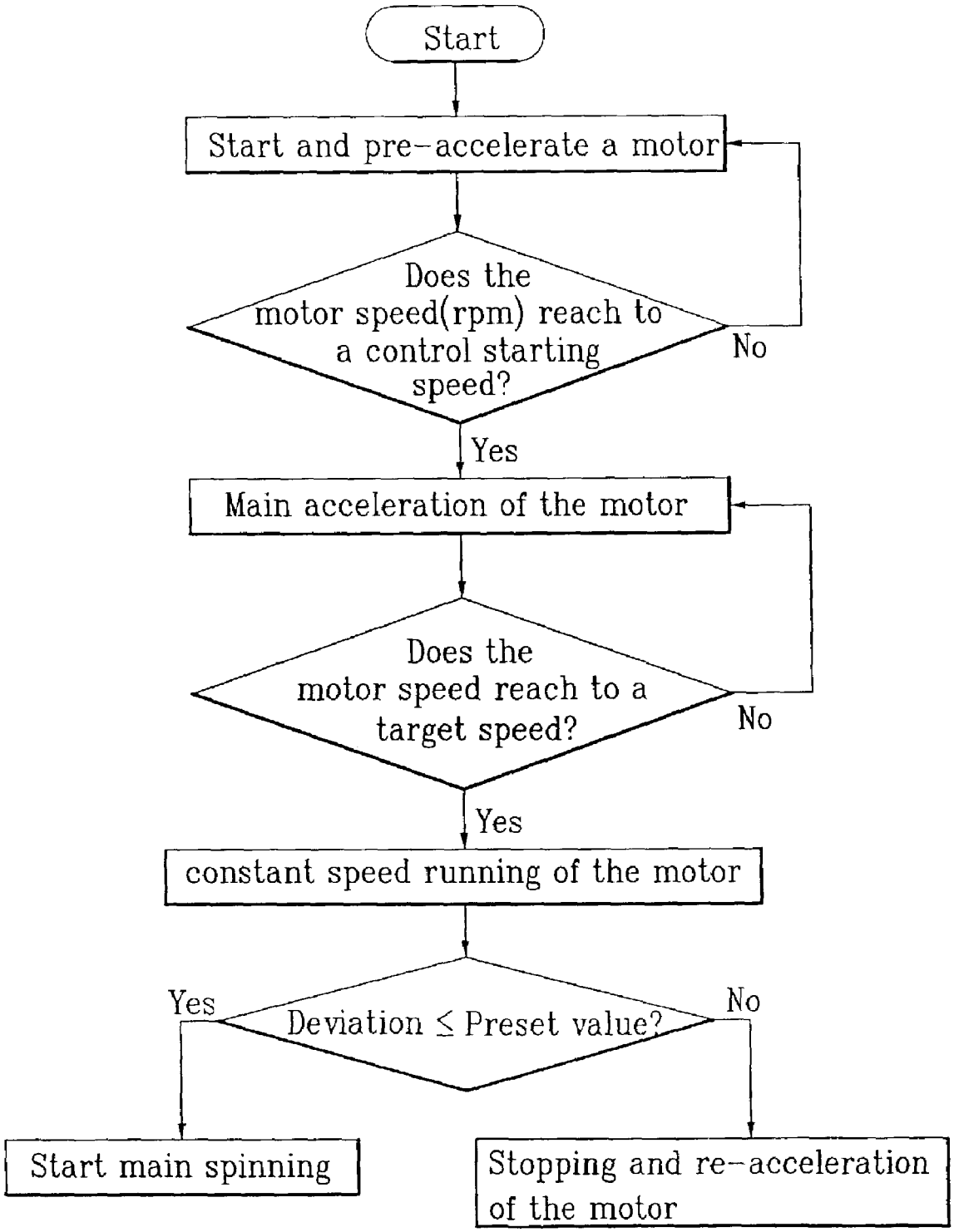
FIG. 5 is a flow chart of method steps for controlling a dehydrating operation of a drum type washing machine in accordance with a first preferred of the present invention.
Figure 7:
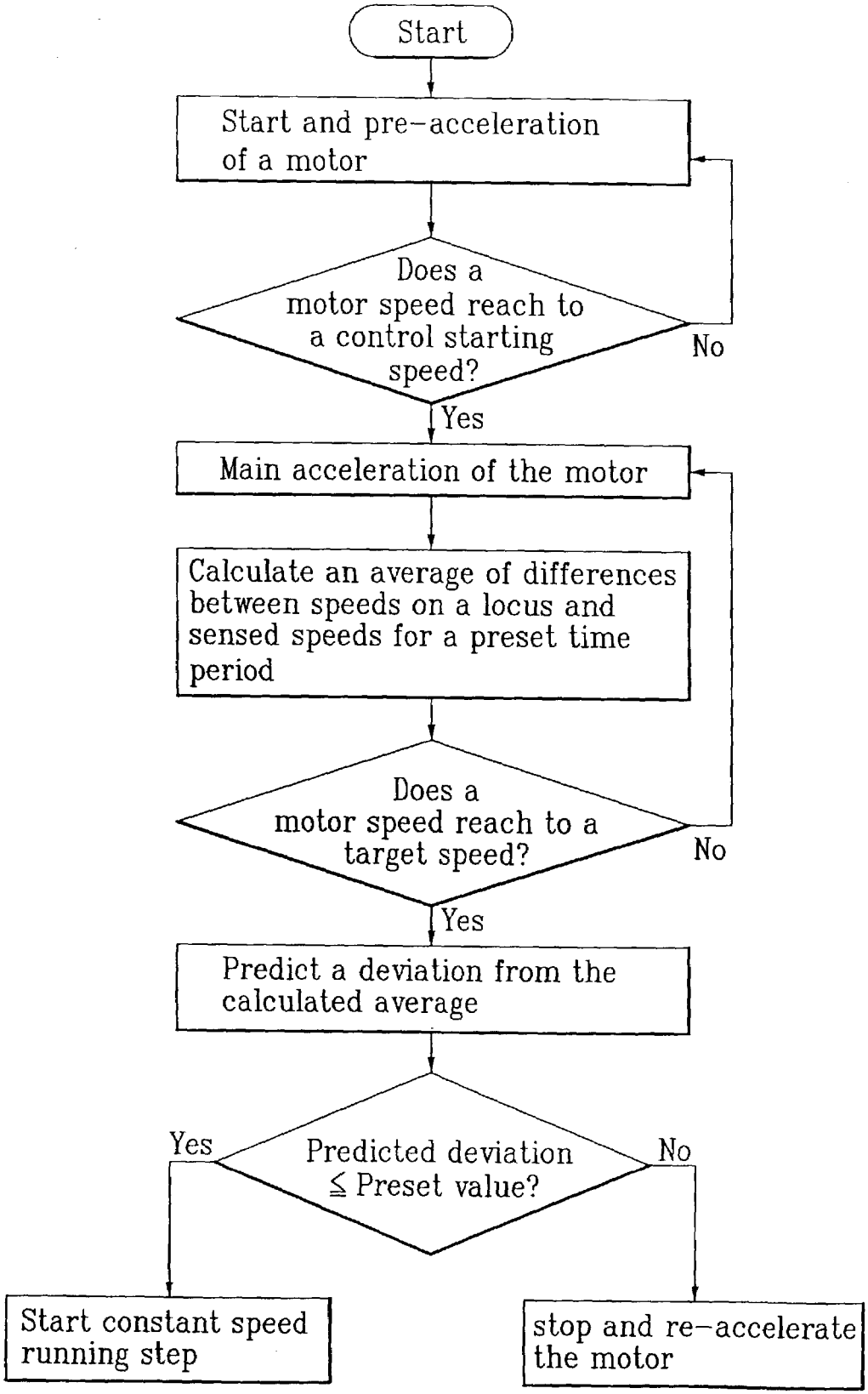
FIG. 7 is a flow chart showing method steps for controlling a dehydrating operation of a drum type washing machine in accordance with a second embodiment of the present invention.
Figure 8:
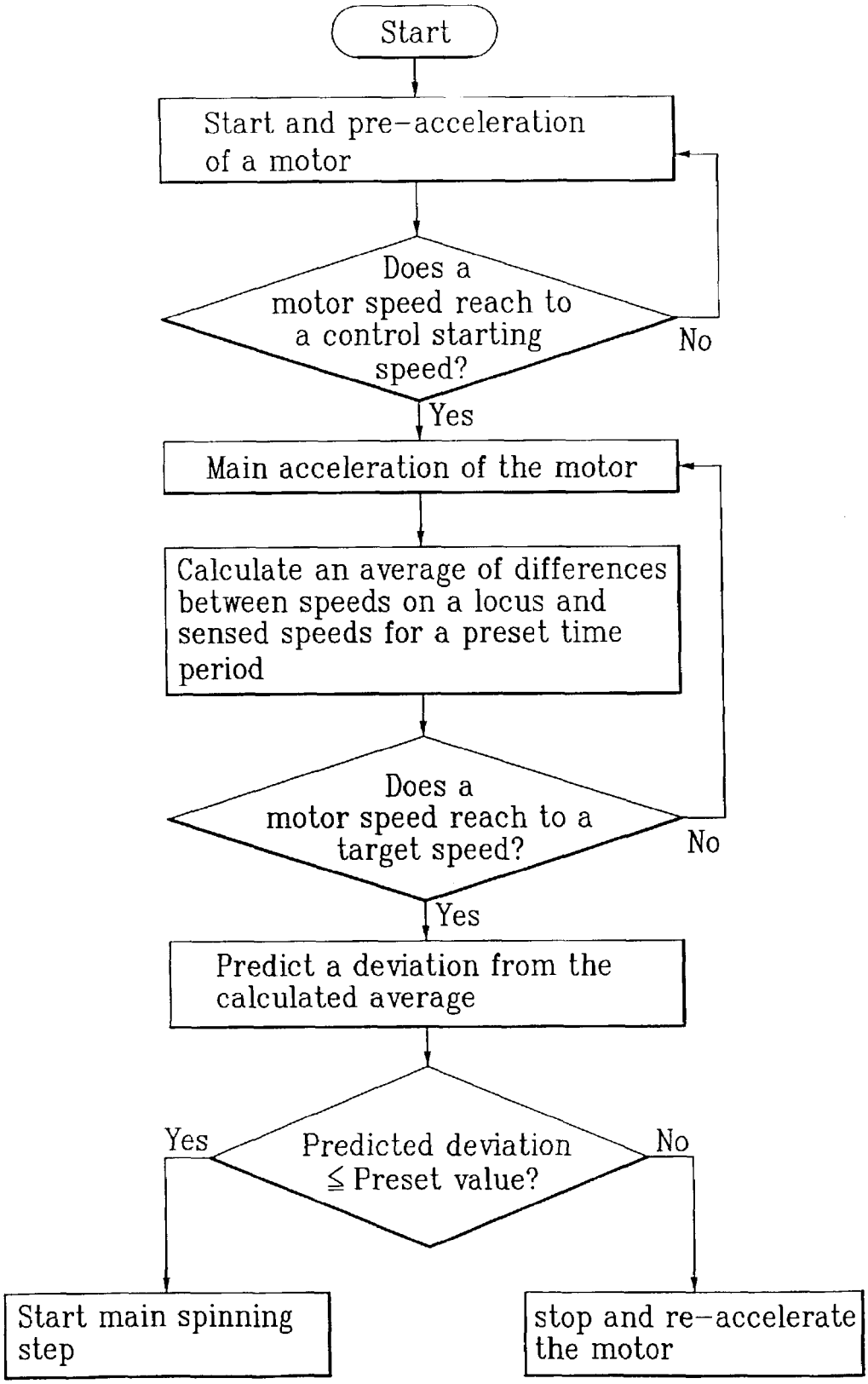
FIG. 8 is a flow chart of method steps for controlling a dehydrating operation of a drum type washing machine in accordance with a third embodiment of the present invention.

The present invention will hereinafter be described with reference to the accompanying drawings. FIG. 2 is a flow chart of method steps for controlling the dehydrating operation of a drum type washing machine in accordance with a preferred embodiment of the present invention. FIG. 3 is a graphical view of a state of motor speed control under a no load condition in accordance with a preferred embodiment of the present invention. FIG. 4 is a graphical view of a state of motor speed control under a preset load condition in accordance with a preferred embodiment of the present invention. FIG. 5 is a flow chart of method steps for controlling a dehydrating operation of a drum type washing machine in accordance with a first preferred of the present invention. FIG. 6 is a table comparing the operation control method of the first embodiment shown in FIG. 5 and the operation control method of the background art showing pre-spinning time periods and a number of main spinning attempts thereof. FIG. 7 is a flow chart showing method steps for controlling a dehydrating operation of a drum type washing machine in accordance with a second embodiment of the present invention. FIG. 8 is a flow chart of method steps for controlling a dehydrating operation of a drum type washing machine in accordance with a third embodiment of the present invention.

FIG. 2 is a flow chart showing the steps of a method for controlling the dehydrating operation of a drum type washing machine in accordance with a preferred embodiment of the present invention, wherein it can be noted that the method includes a pre-acceleration step and a main acceleration step. The pre-acceleration step includes accelerating the motor to a preset speed, i.e., to a control starting speed, when a spinning cycle is started under the control of a controller, after the motor rotating the drum is started. Once the motor speed reaches the control starting speed, the controller controls the motor to carry out the main acceleration step to accelerate the motor to a preset target speed, e.g., such that the motor speed rises slowly along a linear locus having a preset acceleration slope (a).

Figure 1:
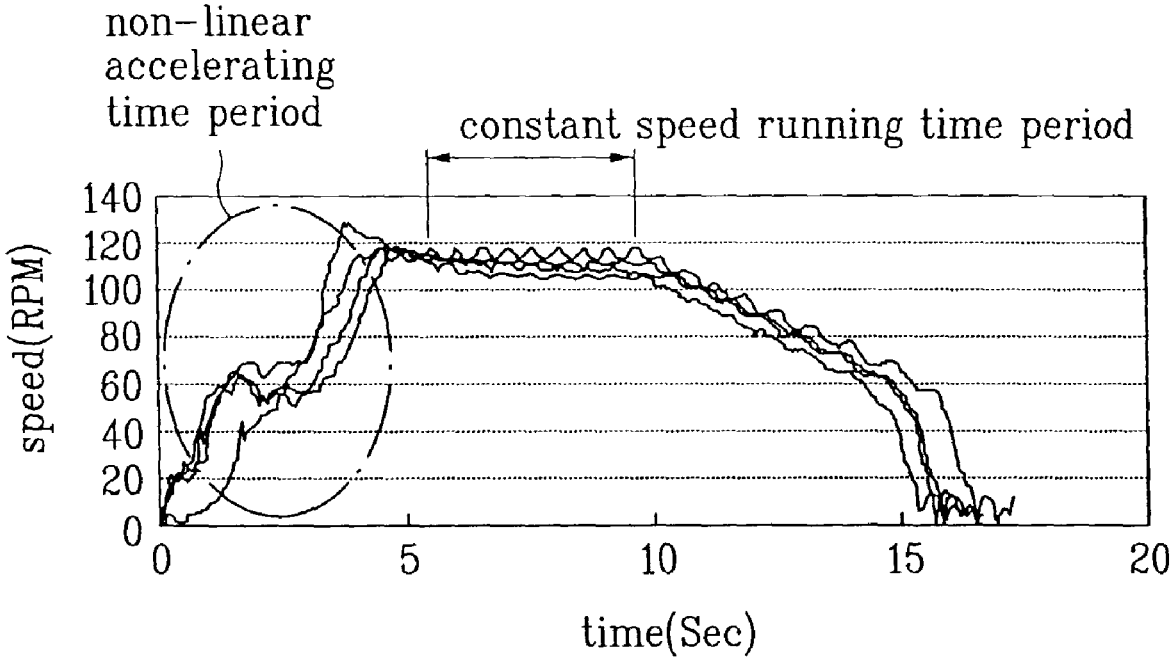
FIG. 1 BACKGROUND ART
FIG. 1 is a graphical view of a state of motor speed control of a drum type washing machine of the background art.

FIGS. 3 and 4 show motor control states at an initial state of the spinning cycle of the present invention. For reference, FIG. 3 is a graphical view of a state of motor speed control under a no load condition in accordance with a preferred embodiment of the present invention. FIG. 4 is a graphical view of a state of motor speed control under a preset load condition in accordance with a preferred embodiment of the present invention. As shown in FIGS. 3 and 4, if the motor is controlled by the method of the present invention at an initial stage of the spinning cycle, the sharp rise of the motor speed, e.g, of the background art as shown in FIG. 1, can be effectively prevented since the motor is slowly accelerated slowly following a linear locus having a preset acceleration slope (a).

The starting of lifting and dropping of the laundry along the inside wall of the drum occurs at a speed in the vicinity of 40 rpm in the drum type washing machine. The laundry will start to stick to the wall of the drum by centrifugal force at a speed in the vicinity of 90 rpm. In general, the deviation is measured while driving the drum at a constant speed when the laundry does not fall, i.e., the deviation does not vary, which is in general set to be 110 rpm. Measurement of the deviation within an appropriate speed is preferable since the measurement of the deviation when the deviation is too great may provide excessive load on mechanical elements starting from the drive motor.

Accordingly, in the control of motor acceleration for rotating the drum in the present invention, it is preferable that the control starting speed is limited to a range of 35–45 rpm, and the target speed is limited to a range of 90–130 rpm. Although proportional control (P), proportional integral control (PI), and proportional derivative control (PD) may be used to control the motor speed to follow the preset acceleration slope from the control starting speed to a target speed, it is preferable to employ a proportional integral derivative control (PID control) which is a combination of the aforementioned three methods.

An exemplary case will be described in greater detail hereinafter in which the acceleration of the drum is controlled with the control starting speed set at 40 rpm, the target speed set at 95 rpm, and a time period for the drum speed to reach target speed from the control starting speed is set at 10 seconds.

$$\text{Acceleration slope } (a) = \frac{95\ (\text{rpm}) - 40\ (\text{rpm})}{10\ (\text{sec})} = 5.5\ [\text{rpm/sec}]$$

If the time period to reach the target speed is set at 15 seconds while setting the control starting speed and the target speed the same as above, the acceleration slope (a) is calculated to be 3.67. If the time period is set at 20 seconds, the acceleration slope (a) is calculated to be 2.75.

The controller can control the motor speed to follow the speed on the locus by making a PID control such that the error is zero. A speed on the locus equals acceleration slope times an acceleration time period plus the control starting speed. An error equals a speed on the locus minus a sensed speed. In the meantime, the method for controlling the motor at the initial stage of the spinning cycle of the drum type washing machine may have a variety of embodiments depending on the subsequent spinning cycle, which will be explained with reference to the attached drawings.

FIG. 5 is a flow chart showing method steps for controlling the dehydrating operation of a drum type washing machine in accordance with a first preferred embodiment of the present invention. The first embodiment includes a pre-acceleration step, a main acceleration step and a constant speed running step. Since the pre-acceleration step and the main acceleration step have been explained hereinabove, the constant speed running step will be explained hereinafter.

The constant speed running step is carried out when the motor speed reaches the target speed. The constant speed running step determines the start of the main spinning cycle while running at constant speed for a preset time period. The start of the main spinning cycle from the constant speed running is determined with reference to the deviation of the drum measured through a variation of the motor speed. If the deviation is within a preset range, the main spinning cycle is started. If the deviation is greater than the preset range, the motor is stopped temporarily and restarted. Therefore, if the deviation is greater than the preset value after stopping the motor, the motor speed proceeds to the constant speed running step through the pre-acceleration step and the main acceleration step, and then determines the start of the main spinning step.

FIG. 6 is a table comparing the first operation control method in FIG. 5 and the operation control method of the background art showing pre-spinning time periods and a number of main spinning attempts thereof. Referring to FIG. 6, a control result of the related art operation control method and the first embodiment operation control method are compared which shows that an average pre-spinning time period for the operation control method of the first embodiment is 65–118 seconds. This provides a reduction of approx. 80–90% from an average pre-spinning time period of the operation control method of the related art. Moreover, an average number of main spinning attempts of the present invention is 2.8–4.0 times, with a reduction of approx. 10% from the main spinning attempts of the background art. This favorable result is obtained since the spinning control of the present invention eliminates the sharp rise period of motor speed and prevents an increase of deviation typically coming from the sharp rise of the motor speed. Accordingly, deviation is reduced in the present invention.

FIG. 7 is a flow chart showing method steps for controlling the dehydrating operation of a drum type washing machine in accordance with a second embodiment of the present invention. The second embodiment includes a deviation predicting step when the main acceleration step progresses and a step of determining the start of the constant speed running step in addition to the pre-acceleration step and the main acceleration step. A detailed explanation of the pre-acceleration step and the main acceleration step will not be repeated hereinafter as these steps are described hereinabove, but the deviation predicting step and the step of determining the start of the constant speed running step will be explained in greater detail hereinafter.

Referring to FIG. 7, the deviation predicting step includes a monitoring step and a deviation measuring step carried out during the main acceleration step. In the monitoring step, a difference between the speed on the locus and the actual sensed speed is monitored a few times for a preset time period during the period of main acceleration. In the deviation measuring step, an average of differences between the monitored speeds on the locus and the sensed speeds is calculated to measure the deviation which will be explained in detail with reference to FIGS. 3 and 4.

Referring to FIGS. 3 and 4, when the motor speed is accelerated according to a predetermined acceleration slope (a) in a spinning cycle, there is a small or almost no difference between the monitored speed on the locus and the sensed speed as shown in FIG. 3, e.g., in a case of no load operation when there is little or no deviation. There is a great difference between the monitored speed on the locus and the sensed speed as shown in FIG. 4, e.g., in a case of a load when there is a great deviation. Thus, the deviation can be predicted to a certain extent from the difference between the speed on the locus and the sensed speed.

When the motor speed is accelerated according to an acceleration slope 'a,' the controller monitors a difference between the speed on the locus and the actual sensed speed for a few times and a preset time period, and calculates an average of the differences to predict the deviation with reference to the calculated average. The average can be expressed as an equation shown below.

$$\text{Average} = \frac{\text{Sum of speed on a locus} - \text{sensed speed for a preset time period}}{\text{Monitored number of times for the preset time period}}$$

Referring to FIG. 7, once the deviation can be predicted to some extent from the calculated average, the step of determining the start of the constant speed running step is carried out for sensing an actual accurate deviation with reference to the deviation predicted in the deviation prediction step. If the predicted deviation in the deviation prediction step is greater than the preset value, the motor is stopped and re-accelerated in the step for determining the start of the constant speed running step. If the predicted deviation is smaller than the preset value, the constant speed running step is started in which an accurate deviation is sensed while driving the motor at a constant speed for a preset time period after the motor reaches the target speed.

Thus, the second embodiment of the present invention can reduce the pre-spinning time period in comparison to the control method of the background art in which the deviation is sensed in a constant speed running step after the acceleration step. In the second embodiment, the constant speed running step is started and the actual deviation is measured to determine the start of the main spinning cycle if it is predicted that there is a small deviation in the main acceleration step. The step of stopping and re-starting the motor is initiated without starting the constant speed running step if it is predicted that there is a great deviation in the main acceleration step.

FIG. 8 is a flow chart showing method steps for controlling a dehydrating operation of a drum type washing machine in accordance with a third embodiment of the present invention. The third embodiment includes a deviation predicting step when the main acceleration step progresses and a step of determining the start of the main spinning step. In addition, the third embodiment includes the pre-acceleration step, and the main acceleration step after starting the motor. Explanation of the pre-acceleration step, the main acceleration step, and the deviation predicting step, which have been explained hereinabove, will be omitted hereinafter. However, the step of determining the start of the main spinning step will be explained in greater detail hereinafter.

Though the third embodiment is similar to the second embodiment of the present invention explained with reference to FIG. 7, the third embodiment is different in that the it directly determines the start of the main spinning step without starting the constant speed running step. In the step of determining the start of the main spinning step, it is determined to stop and re-accelerate the motor when the predicted deviation is greater than the preset value. The main spinning step is started without initiating the constant speed running step after the motor reaches the target speed when the predicted deviation is smaller than the preset value.

Accordingly, the third embodiment of the present invention can reduce the pre-spinning time period significantly, thereby leading to a reduction in the entire spinning cycle period, and a reduction in power consumption as compared to the method of the background art. In the third embodiment, the main spinning step is started directly with reference to the deviation predicted in the deviation predicting step carried out during the main acceleration step. Alternatively, the motor is stopped and re-accelerated without initiating the constant speed running step, which permits the elimination of the time period required for the constant speed running step for the prediction of deviation.

The method for controlling the dehydrating operation of the drum type washing machine of the present invention has the following advantages. First, the slow acceleration of drum motor speed along an acceleration slope in the spinning cycle prevents a sharp rise of the motor speed caused by deviation of the drum during the acceleration of the motor. Second, the reduction of the deviation of the center of gravity of the laundry in the drum in the spinning cycle permits a reduction of a number of spinning starting attempts that reduces a total spinning cycle period.

Third, the simultaneous progression of the main acceleration step and the deviation prediction step and the determination of the start of the constant speed running step or the main spinning step with reference to the predicted deviation permits a significant reduction in the pre-spinning time period in comparison to the method of the background art in which the constant speed running step is carried out without any condition. Fourth, the power consumption is reduced as the spinning time period is shortened.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for controlling a dehydrating operation of a drum type washing machine, said method comprising:

accelerating a motor driving a drum of the washing machine to a predetermined control starting speed during a pre-acceleration step; and substantially immediately upon reaching the control starting speed, accelerating the motor from the control starting speed to a target speed along a linear locus having a preset acceleration slope during a main acceleration step, the accelerating during the main acceleration step being different from the accelerating during the pre-acceleration and running the motor at a fixed speed for a predetermined time period when the motor reaches the target speed during a constant speed running step, wherein said constant speed running step determines whether to start a main spinning cycle of said washing machine.

2. The method according to claim 1, wherein the motor is controlled by PID control during the main accelerating step.

3. The method according to claim 1, wherein the control starting speed is within a range of 35–45 rpm.

4. The method according to claim 1, wherein the target speed is within a range of 90–130 rpm.

5. The method according to claim 1, wherein the step of determining whether to start the main spinning cycle is determined from the constant speed running step by measuring a deviation of a center of gravity of laundry in the drum with reference to a variation of motor speed.

6. The method according to claim 5, wherein the main spinning cycle is started if the deviation measured in the constant speed running step is within a preset value.

7. The method according to claim 5, wherein the motor is stopped and then re-started if the deviation measured in the constant speed running step is greater than a preset value.

8. The method according to claim 1, wherein an average rate of acceleration of the motor during the pre-acceleration step is different than an average rate of acceleration of the motor during the main acceleration step.

9. The method according to claim 8, wherein the average rate of acceleration of the motor during the pre-acceleration step is greater than the average rate of acceleration of the motor during the main acceleration step.

10. The method according to claim 1, further comprising accelerating the motor from the target speed to start a main spinning cycle of said washing machine.

11. A method for controlling a dehydrating operation of a drum type washing machine, said method comprising:

accelerating a motor driving a drum of the washing machine to a predetermined control starting speed during a pre-acceleration step; and substantially immediately upon reaching the control starting speed, accelerating the motor from the control starting speed to a target speed along a linear locus having a preset acceleration slope during a main acceleration step, the accelerating during the main acceleration step being different from the accelerating during the pre-acceleration step;

predicting a deviation of the center of gravity of laundry in the drum during the main acceleration step; and determining whether to start a constant speed running step for sensing and actual deviation by referencing the deviation predicted in the deviation predicting step.

12. The method according to claim 11, wherein the step of predicting the deviation includes the steps of:

monitoring differences between the speed on the linear locus and an actual sensed speed a number of times during a preset time period during the main acceleration step; and calculating an average of the monitored differences between the speeds on the locus and the actual sensed speeds to measure the deviation.

13. The method according to claim 11, wherein the step of determining whether to start the constant speed running step includes stopping and re-accelerating the motor if the predicted deviation is greater than a preset value.

14. The method according to claim 11, wherein the step of determining whether to start the constant speed running step includes sensing the actual deviation by running the motor at a fixed speed for a preset time period after the motor reaches the target speed if the predicted deviation is smaller than a preset value.

15. The method according to claim 11, wherein the motor is controlled by PID control during the main accelerating step.

16. The method according to claim 15, wherein the control starting speed is within a range of 35–45 rpm.

17. The method according to claim 16, wherein the target speed is within a range of 90–130 rpm.

18. A method for controlling a dehydrating operation of a drum type washing machine, said method comprising:

accelerating a motor driving a drum of the washing machine to a predetermined control starting speed during a pre-acceleration step; and substantially immediately upon reaching the control starting speed, accelerating the motor from the control starting speed to a target speed along a linear locus having a preset acceleration slope during a main acceleration step, the accelerating during the main acceleration step being different from the accelerating during the pre-acceleration step;

predicting a deviation of the center of gravity of laundry in the drum during the main acceleration step; and whether to start a main spinning cycle by referencing the deviation measured in the deviation predicting step.

19. The method according to claim 18, wherein the step of determining whether to start the main spinning cycle includes stopping and re-accelerating the motor if the predicted deviation is greater than a preset value.

20. The method as claimed in claim 18, wherein the step of determining whether to start the main spinning cycle includes starting the main spinning cycle immediately after the target speed is reached and if the predicted deviation is smaller than the preset value.

* * * * *